United States Patent [19]

York et al.

[11] Patent Number: 4,786,368

[45] Date of Patent: Nov. 22, 1988

[54] STATIC MIXER RETORTING OF OIL SHALE

[75] Inventors: Earl D. York, Englewood, Colo.; Jay C. Knepper, Lisle; John M. Forgac, Elmhurst, both of Ill.

[73] Assignee: Amoco Corporation, Chicago, Ill.

[21] Appl. No.: 5,459

[22] Filed: Jan. 20, 1987

Related U.S. Application Data

[60] Division of Ser. No. 833,191, Feb. 27, 1986, Pat. No. 4,721,560, which is a continuation-in-part of Ser. No. 782,204, Sep. 30, 1985, Pat. No. 4,597,852.

[51] Int. Cl.[4] ..... C10B 1/04; C10B 53/06

[52] U.S. Cl. ..... 202/99; 202/262; 366/337

[58] Field of Search ..... 201/12, 34, 22, 28; 202/99, 108, 215, 262, 265; 422/224, 228, 232; 366/337, 340, 341; 34/167, 178; 208/432

[56] References Cited

U.S. PATENT DOCUMENTS

| | | | |
|---|---|---|---|
| 269,742 | 12/1882 | Taggart | 366/340 |
| 1,496,896 | 6/1924 | Laffoon | 366/337 |
| 2,624,696 | 1/1953 | Schutte | 201/34 |
| 3,275,304 | 9/1966 | Brundrett | 366/337 |
| 3,751,009 | 8/1973 | Archer | 366/337 |
| 4,207,009 | 6/1980 | Glocker | 366/337 |
| 4,211,606 | 7/1980 | Ponomarev et al. | 201/12 |
| 4,358,207 | 11/1982 | Roth | 366/341 |
| 4,497,751 | 2/1985 | Pluss | 366/337 |
| 4,535,551 | 8/1985 | Groineveld et al. | 34/178 |

*Primary Examiner*—David L. Lacey
*Assistant Examiner*—Joye L. Woodard
*Attorney, Agent, or Firm*—Thomas W. Tolpin; William H. Magidson; Ralph C. Medhurst

[57] ABSTRACT

Oil shale is well mixed and efficiently, effectively, and economically retorted in a special gravity flow retorting process and system which utilizes novel arrangements of internal baffles in a static mixer.

2 Claims, 6 Drawing Sheets

180
176
178
170
174
168
36
34
30
32
44
46
48
50
150
146
148
152
154
156
158
160
162
163
164
165
166
172
38
53
54
3
3
55
52
56
57
60
59
58
30

STATIC MIXER RETORTING OF OIL SHALE

RELATED APPLICATIONS

This application is a divisional patent application of the patent application of Earl D. York, Jay C. Knepper, and John M. Forgac, Ser. No. 833,191, now U.S. Pat. No. 4,721,560, for static mixer retorting of oil shale, filed Feb. 27, 1986, which is a continuation-in-part patent application of U.S. Pat. No. 4,597,852 of Earl D. York, Jay C. Knepper, and John M. Forgac, Ser. No. 782,204, for Static Mixer Retorting of Oil Shale, filed Sept. 30, 1985, issued July 1, 1986.

BACKGROUND OF THE INVENTION

This invention relates to retorting oil shale and, more particularly, to a process for retorting oil shale above ground.

Researchers have renewed their efforts to find alternate sources of energy and hydrocarbons in view of past rapid increases in the price of crude oil and natural gas. Much research has been focused on recovering hydrocarbons from solid hydrocarbon-containing material such as oil shale, coal, and tar sands by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases, and residual carbon. It has been estimated that an equivalent of 7 trillion barrels of oil are contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane, and propene, as well as other products such as hydrogen, nitrogen, carbon dioxide, carbon monoxide, ammonia, steam, and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil", is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons can be done in surface retorts in aboveground vessels or in situ retorts underground. In principle, the retorting of shale and other hydrocarbon-containing materials, such as coal and tar sands, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In surface retorting, oil shale is mined from the ground, brought to the surface, crushed and placed in vessels where it is contacted with a hot solid heat carrier material, such as hot spent shale, ceramic balls, metal balls, or sand or a gaseous heat carrier material, such as light hydrocarbon gases, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the retort and recycled as heat carrier material or discarded. The combustion gases are dedusted in cyclones or electrostatic precipitators.

Surface retorting with solid heat carrier material has many advantages over underground retorting and surface retorting with a gaseous heat carrier media. For example, surface retorting with solid heat carrier material produces a substantially greater product yield than underground retorting. Surface retorting with solid heat carrier material attains better heat transfer, more BTVs per volume and greater thermal efficiency than retorting with a gaseous heat carrier media.

The solid heat carrier material should be well mixed with the raw shale to enhance heat exchange and conversion of kerogen to shale oil and light hydrocarbon gases. In the Lurgi-Ruhrgas process, spent shale is mechanically mixed with raw shale in a screw conveyor. In the Tosco II process, ceramic or metal balls (solid heat carrier material) are mechanically mixed with raw shale in a rotating pyrolysis drum. In fluid bed processes, spent shale is fluidly (turbulently) mixed with raw shale in the presence of a pressurized fluidizing gas.

Mechanical mixing utilizes the advantage of surface retorting with solid heat carrier material, but is expensive and suffers from mechanical breakdown and limited throughput capacity.

Fluid bed retorting with solid heat carrier material also offers the advantages of surface retorting but often requires high operating pressures and substantial amounts of fluidizing gas which requires expensive capital outlays for compressors.

Over the years, a number of gravity flow retorts and other retorts have been suggested. Typifying these retorts are those found in U.S. Pat. Nos. 1,432,101; 1,698,345; 1,917,339; 2,624,696; 2,636,263; 2,774,726; 2,894,899; 2,980,617; 3,267,019; 3,281,349; 3,475,317; 3,597,347; 3,703,442; 4,038,045; 4,069,107; 4,087,347; 4,188,184; 4,199,432; 4,211,606; 4,404,086; 4,436,588; and French Pat. No. 756,778. These retorts have met with varying degrees of success.

It is, therefore, desirable to provide an improved retort which overcomes most, if not all, of the preceding problems.

SUMMARY OF THE INVENTION

A static mixer retort is provided with a unique arrangement and orientation of triangular internal baffles to retort oil shale in a novel, efficient, effective, and economical manner. Advantageously, the unique arrangement of baffles mixes raw oil shale with solid heat carrier material, such as spent oil shale, with unexpected, surprisingly good results over prior art arrangements. Such mixing is virtually complete, full, and random with substantially uniform distribution of raw and spent shale particles. Superior mixing occurs over the special orientation of fixed, stationary baffles, solely by gravity flow. The special orientation of internals deflects and changes the lateral direction of the raw and spent shale in a vastly improved manner and flow pattern to provide much more mixing per given volume than previous suggested static mixers. Advantageously, it is also accomplished in the absence of fluidizing gases to avoid costly gas circulation, treatment, high operating pressures, and expensive capital outlay for compressors, as well as in the absence of moving parts in the retort to prevent costly mechanical breakdowns and avoid the many problems associated with mechanical mixing and rotation.

Positioned below the static mixer is a surge bin to gravitationally pass and accommodate heat transfer and retorting of the raw oil shale and spent oil shale (heat carrier material). The overhead static mixer and underlying surge bin cooperate with each other to provide a two-stage gravity flow retort. The upper portion of the surge bin provides a dilute-phase free-fall zone. The dilute-phase free-fall zone minimizes choking and back mixing of the raw oil shale and solid heat carrier material and serves as a disengagement area to precipitate and disengage large particulates of dust, mainly spent and retorted shale, from the effluent product stream of oil and light hydrocarbon gases. The disengagement area also minimizes entrainment of raw, unretorted fine material in the effluent product stream. The lower portion of the surge provides a dense-phase zone where the shale moves and is completely retorted in a dense-phase moving bed.

Special lines are provided to feed raw and spent oil shale into the static mixer retort. Optimum mixing occurs when the raw and spent shale are fed into the static mixer at an angle of inclination of about 15 degrees relative to the vertical axis of the retort, with the raw and spent shale feed line positioned at an inclusive angle of about 30 degrees to assure effective mass flow. For best results, the raw and spent oil shale preferably intersect the top row baffles at an angle of 22.5 degrees as viewed from the top of the retort (i.e. the horizontal component and projection angle of the shale feed is 22.5 degrees) so that the baffles are positioned at an obtuse angle of 157.5 degrees relative to the feed lines.

In operation, raw and spent oil shale are mixed well as they gravitate downwardly in interrupted free-fall through the unique array of internals in the static mixer. The material is deflected by the internals in a special zigzag flow pattern to attain nearly perfect mixing. Mixing is substantially completed in the static mixer. Heat transfer and kerogen conversion (retorting) are initiated during mixing.

The well-mixed material flows by gravity from the static mixer through the static surge bin. In the upper portion of the surge bin, the material gravitates downwardly in a dilute-phase free-fall zone. In the lower portion of the surge bin, the material gravitates downwardly in a dense-phase moving bed. Conversion (retorting) of the raw oil shale feed to hydrocarbons and other materials is substantially completed in the dense-phase moving bed.

As used throughout this application, the term "retorted" shale refers to spent oil shale which has been retorted to liberate hydrocarbons leaving a residual material containing carbon residue.

The term "spent shale" as used herein means retorted oil shale from which most of the carbon residue has been removed by combustion.

The term "static" as used herein means a vessel or device having no internal moving parts.

The terms "dense phase" or "dense bed" as used herein mean a phase or bed, respectively, in which the natural density of the material or shale contained therein has from about 30% to about 40% voids.

The terms "dilute phase" and "dilute bed" as used herein mean a phase or bed which contains less than about 10% solids in the space occupied by the phase or bed.

The terms "normally gaseous", "gases", or "normally liquid oil", unless otherwise stated, are relative to the conditions of the subject material at a temperature of 77° F. (25° C.) and a pressure of one atmosphere.

A more detailed explanation of the invention is provided in the following description and appended claims taken in conjunction with the accompanying drawings.

DETAILED DESCRIPTION OF THE PREFERRED EMBODIMENTS

Figures 1, 2:
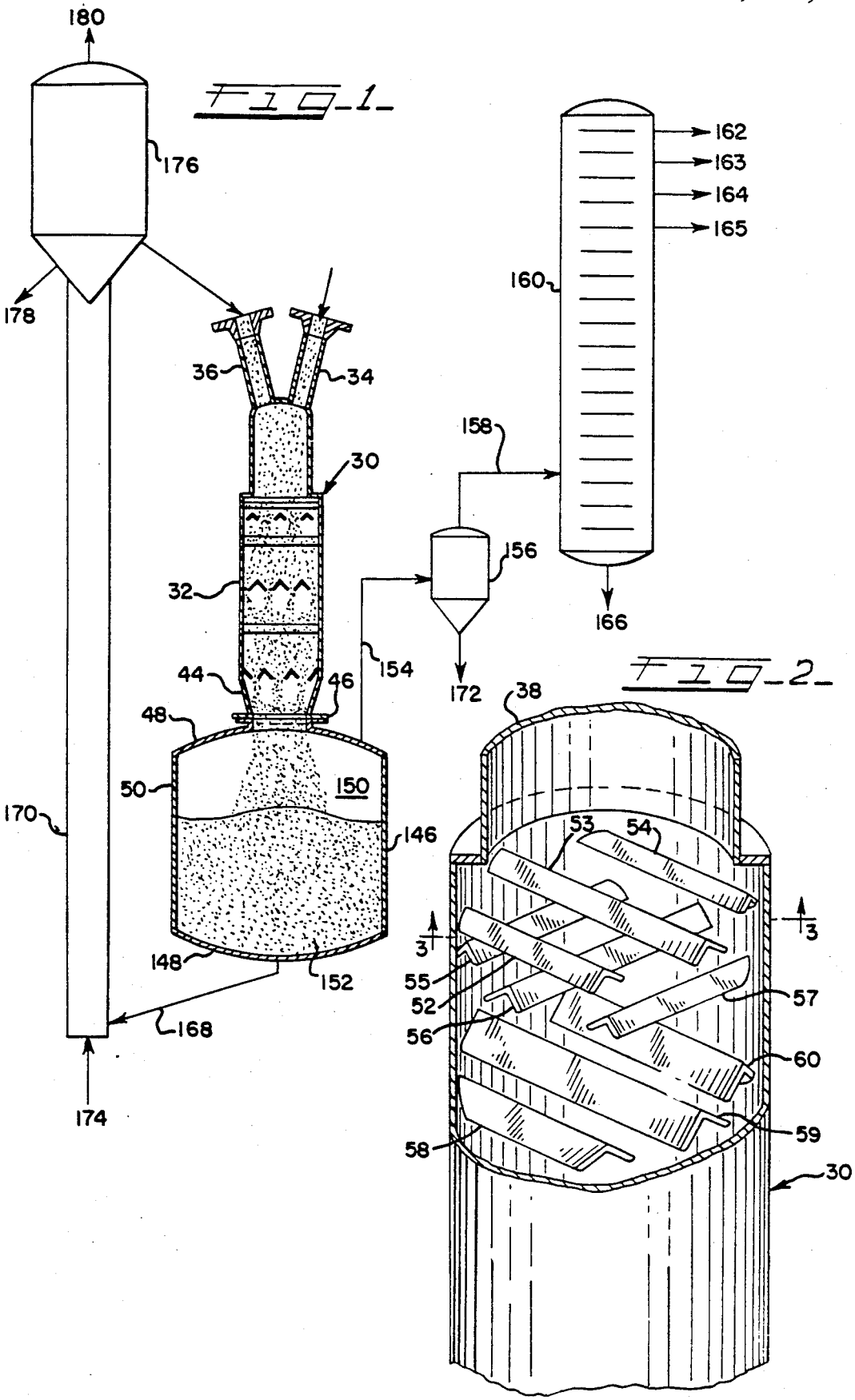
FIG. 1 is a schematic flow diagram of a static mixer retorting process and system in accordance with principles of the present invention.
FIG. 2 is an enlarged fragmentary perspective view of the static mixer with portions cut away for ease of illustration and clarity.

Referring now to FIG. 1, a static mixer, gravity flow, retorting process and system 30 is provided to retort solid hydrocarbon-containing material, such as oil shale, tar sands, uintaite (gilsonite), lignite, peat, and oil-containing diatomaceous earth (diatomite), for use in producing synthetic fuel. While the process and system of the present invention is described hereinafter with particular reference to the processing of oil shale, it will be apparent that the process and system can also be used to retort other solid hydrocarbon-containing materials, such as tar sands, uintaite (gilsonite), lignite, peat, and oil-containing diatomaceous earth.

In the process and system 30, raw oil shale is crushed, sized, and sorted by conventional crushing equipment such as an impact crusher, jaw crusher, gyratory crusher, or roll crusher and by conventional screening equipment such as a shaker screen or vibrating screen. Preferably, raw oil shale containing an oil yield of at least 15 gallons per ton of shale is used in order to make the process and system self-sustaining in terms of energy requirements. The crushed shale is preheated to a temperature between ambient temperature and 700° F., preferably between 250° F. and 600° F., to dry off most of the moisture contained in the shale.

The crushed and preheated oil shale particles are fed into an overhead, generally upright, elongated stationary static mixer retort 32 (also referred to as the "static mixer") through a raw shale feed line, conduit, or pipe 34 by gravity flow or other conveying means, such as a lift elevator or a screw conveyor feeder. The raw oil shale particles are fed into the static mixer at a solids flux flow rate between 500 and 10,000 lbs/ft$^2$ hr, and preferably between 2,000 and 6,000 lbs/ft$^2$ hr for best results.

Solid heat carrier material, preferably fully combusted, spent oil shale, is fed by gravity flow or other conveyor means through a heat carrier line, conduit, or pipe 36 into the static mixer 32 at a retorting temperature from 1,000° F. to 1,400° F., preferably from 1,100° F. to 1,300° F., and most preferably from 1,150° F. to 1,250° F. Heat carrier material in excess of 1,400° F. should not normally be fed into the static mixer because it will decompose substantial quantities of carbonates in the oil shale. Heat carrier material below 1,000° F. should not be fed into the static mixer, if possible, because fine removal problems are aggravated and heat carrier input requirements are increased because of the high attrition rates at high recycle ratios.

The ratio of the solids flux flow rate of the heat carrier material (spent shale) being fed into the static mixer by heat carrier line 36 to the solids flux flow rate of raw oil shale in lbs/ft$^2$ hr fed into the static mixer by raw feed line 34 is in the range from 2:1 to 10:1, and preferably as low as possible for better results.

Figure 4:
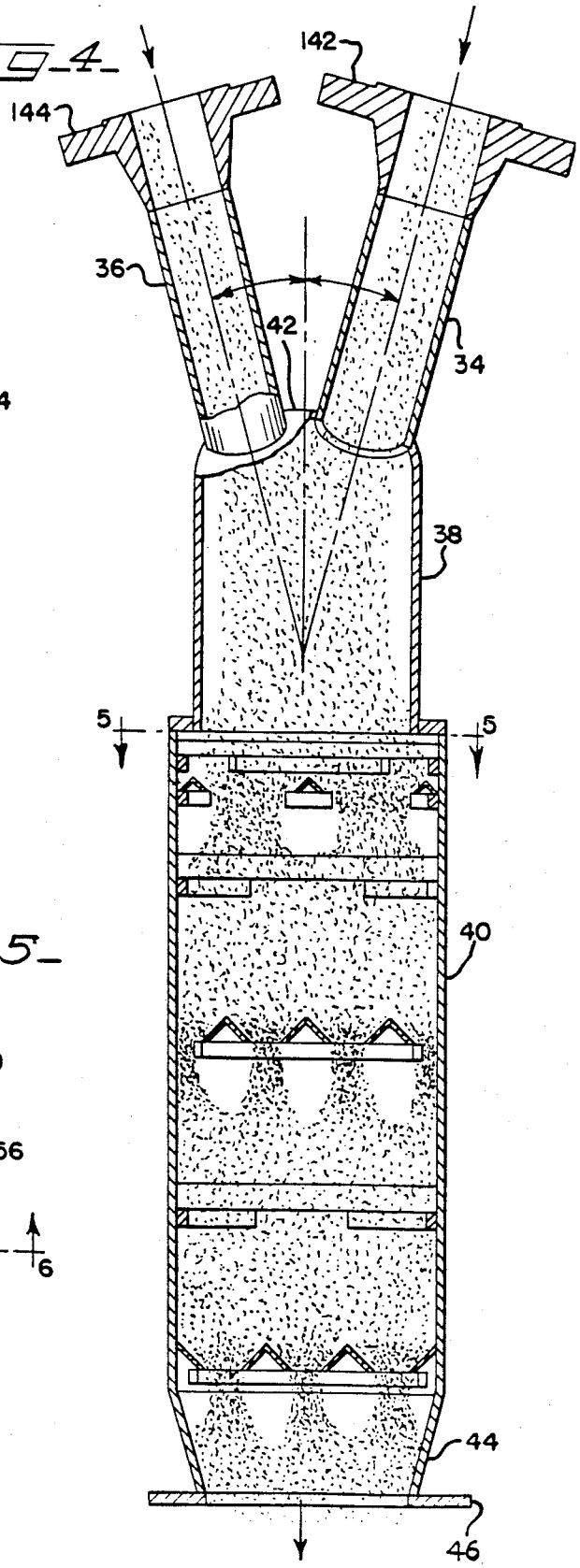
FIG. 4 is an enlarged cross-sectional view of the static mixer.

As best shown in FIG. 4, the static mixer 32 is an elongated vertical vessel with an upper free-fall section 38 and an elongated, lower, deflector (internal-containing) section 40. The upper free-fall section is empty and therefore contains no moving parts or stationary deflectors (internals) within its interior which might deflect or otherwise interfere with the free vertical fall of shale. The upper free-fall section has a domed, rounded, convex top or top portion 42 which intersects, receives, and communicates with the bottom of the feed lines 34 and 36. In the preferred embodiment, our work to date indicates that the upper free-fall section 38 has a circular cross-section with an inside diameter of 6 to 7.5 inches and a height of 6 to 11 inches. The elongated lower deflector section 40 preferably has a greater diameter and a much greater height than the upper free-fall section. In the preferred embodiment, the free-fall section has a circular cross-section with an inside diameter of 7.5 to 9 inches and a height of 2 to 3, and preferably 2.5, times the height of the upper free-fall section. Extending downward from the bottom portion of the lower deflector section is a frustoconical, truncated, downwardly converging flared neck 44 with an outwardly extending annular flange 46. The bottom of the neck has a smaller diameter and cross-sectional area than the peripheral wall of the deflector section and provides a discharge outlet, opening, or mouth which feeds into and communicates with the upper portion 48 of a generally upright, elongated, stationary static surge bin 50 as shown in FIG. 1. The flange 46 is secured to the upper portion of the surge bin. The surge bin serves as an inventory control to attain a generally constant flow of shale in the retorting system as well as to allow adequate residence time for retorting (pyrolysis).

Figure 5:
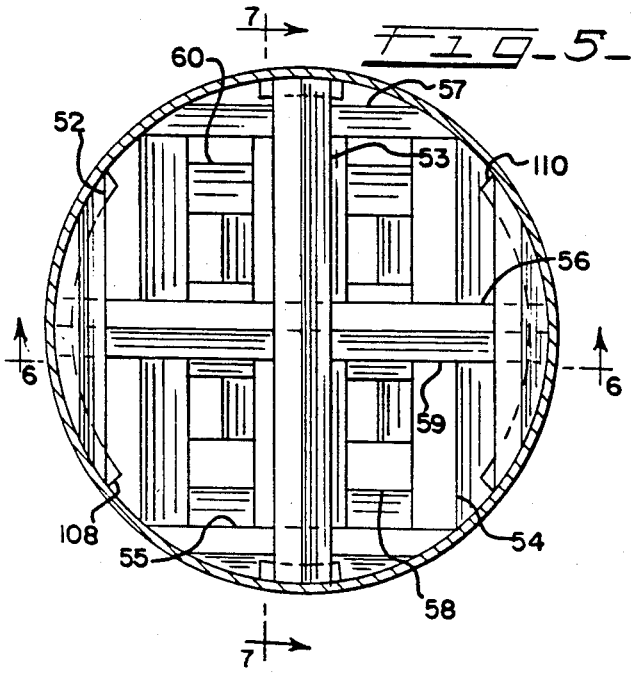
FIG. 5 is a greatly enlarged cross-sectional view of the static mixer taken substantially along line 5—5 of FIG. 4.

In order to attain acceptable solid mixing of the raw and spent oil shale, a specially arranged matrix, series, and set of stationary internals 52–71 (FIGS. 6 and 7) and 72–107 (FIGS. 8 and 9), sometimes referred to as deflectors, baffles, or elements, are positioned within the interior of the static mixer. The internals are welded or otherwise fixedly secured to support brackets 108–123 (FIGS. 6 and 7) and 124–143 (FIGS. 8 and 9) which are welded to the inner wall surface of the lower deflector section. The internals are positioned and arranged in alternate horizontal tiers, arrays, rows, or levels of longitudinally positioned internals and laterally positioned internals, spaced alternately vertically apart and below each other, in a special oriented matrix as shown in FIG. 5. Elongated angle irons which form inverted triangular-shaped baffles provide most of the internals. The apex of the triangular internals face upwardly. The sides of the triangular internals diverge downwardly and outwardly. Side elements 64 and 67 are each made of half an angle iron or plate equivalently cut.

As more fully explained below, the special orientation, configuration, and arrangement of internals in FIGS. 6–9 have been found during extensive testing to provide unexpected, surprisingly good, superior, complete mixing with almost perfect uniform distribution of raw and spent oil shale particles. Such mixing provides a substantially uniformly distributed, well-mixed matrix of fresh and spent oil shale. The arrangement of internals shown in FIGS. 10–19 and in Ponomarev et al., U.S. Pat. No. 4,211,606, as well as the use of disc and donut internals, Kenics-type twisted internals, and the use of no internals, were found during the testing to provide unacceptably mediocre to very poor, incomplete mixing of raw and spent shale.

Figure 6:
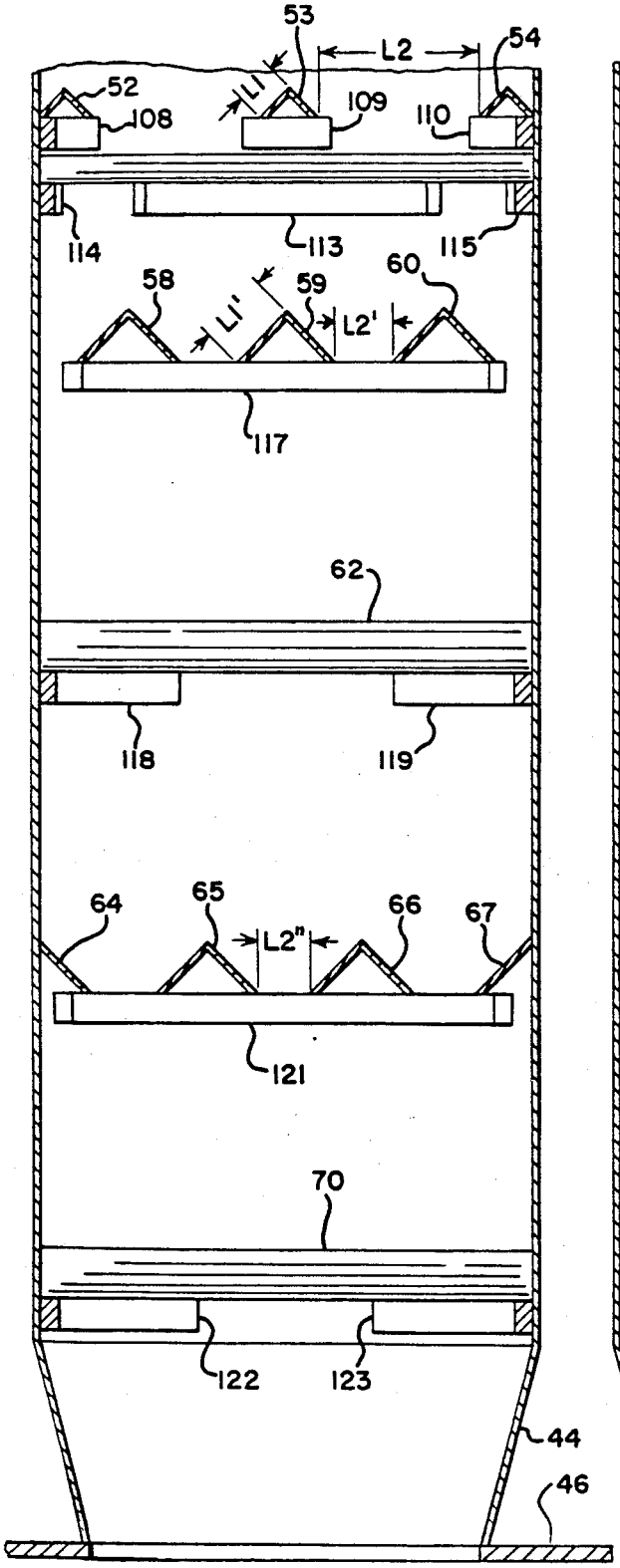
FIG. 6 is a greatly enlarged cross-sectional view of the static mixer taken substantially along line 6—6 of FIG. 5.
Figure 7:
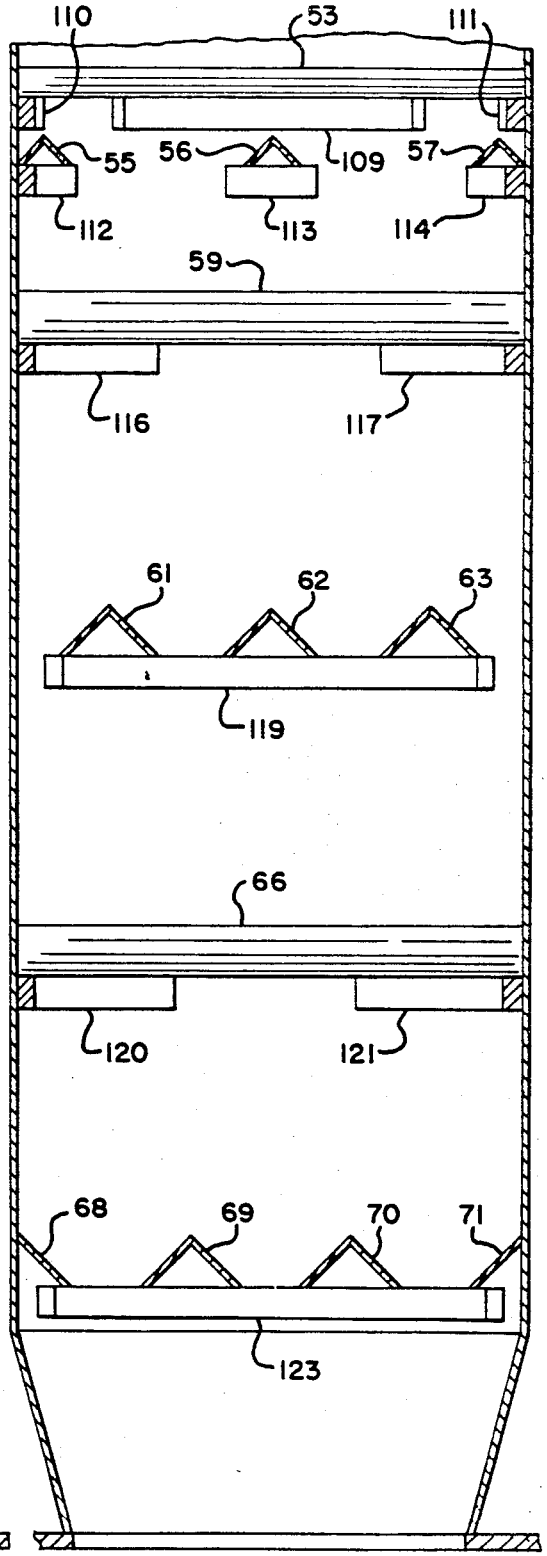
FIG. 7 is a greatly enlarged cross-sectional view of the static mixer taken substantially along line 7—7 of FIG. 5.

The static mixer of FIGS. 6 and 7 has six vertically spaced tiers, arrays, levels, and rows of triangular-shaped baffles with upwardly pointing apexes. The baffles are made of angle irons and extend horizontally across the static mixer. The bases of the baffles in each row are coplanar and in horizontal alignment with each other. The apexes (peaks) of the baffles in each row are of the same height and in horizontal coplanar relationship to each other. The sides (slanted faces) of all of the baffles are at a 45-degree angle relative to the vertical axis. Adjacent sides of each baffle are positioned at a 90-degree (right) inclusive angle from each other. The top (upper) two rows of baffles are referred to as the inlet rows. There are three baffles 52–54 in the top (first) inlet row and three baffles 55–57 in the second inlet row. Each of the baffles in the inlet rows are the same size. The minimum vertical distance (height) and spacing between the apexes (tops) of the baffles in the second inlet row and the bases (bottoms) of the baffles in the top inlet row is 0.375 to 0.75 inch, preferably 0.5 inch for best results. The minimum cross-sectional span L1 of each side of the baffle is 0.5 to 2 inches, preferably 0.5 inch for best results. The minimum horizontal distance and spacing L2 between the bases of adjacent baffles in each of the inlet rows is 2 to 3.5 inches, preferably 2.75 inches for best results. The minimum horizontal distance and spacing between the apexes of adjacent baffles in each of the inlet rows is 3 to 3.5 inches, preferably 3.375 inches for best results. The baffles 52–54 in the top inlet row are parallel to each other. The baffles 55–57 in the second inlet row are parallel to each other and oriented at a 90-degree (right) angle to the baffles in the top inlet row, as viewed from the top.

As shown in the static mixer of FIGS. 6 and 7, there are three baffles 58–60 in the third row (from the top) and three baffles 61–63 in the fourth row (from the top). Each of these baffles is of the same size, height, and side (slanted face) dimension. The minimum vertical distance (height) between the apexes of baffles 58–60 in the third row and the bases of baffles 55–57 in the second row is 3 to 5 inches, preferably 4 inches for best results. The minimum vertical distance (height) between the apexes of baffles 61–63 in the fourth row to the bases of baffles 58-60 in the third row is 3 to 5 inches, preferably 4 inches for best results. The minimum cross-sectional span L1' of each side of the baffles in the third and fourth row is 0.25 to 2 inches, preferably 1 inch for best results. The minimum horizontal distance and spacing L2' between the bases of adjacent baffles in the third row and in the fourth row is 0.25 to 1.25 inches, preferably at least 0.75 inch, and most preferably 1 inch for best results. The minimum horizontal distance and spacing between the apexes of adjacent baffles in the third row and in the fourth row is 2 to 2.5 inches, preferably 2.8125 inches for best results. The baffles in the third row are parallel to each other and to the baffles in the first (top) row. The apex of the center baffle 59 in the third row is in vertical alignment and registration with the center baffle 53 in the first row and positioned along the vertical axis. The apexes of the outside (outer) baffles 58 and 60 in the third row are laterally offset and spaced inwardly of the apexes of the outside (outer) baffles 52 and 54 in the first row. The baffles in the fourth row are parallel to each other and to the baffles in the second row. The apex of the center baffle 62 in the fourth row is in vertical alignment and registration with the center baffles 56 in the second row. The apexes of the outside (outer) baffles 61 and 63 are laterally offset and spaced inwardly of the outside (outer) baffles 55 and 57 in the second row. The baffles in the third row are at right angles to the baffles in the second and fourth rows as viewed from the top.

In the static mixer of FIGS. 6 and 7, there are four baffles 64–67 or 68–71 in each of the fifth and sixth rows (from the top). The two central (inward) baffles 65 and 66, and 69 and 70, in the fifth and sixth rows are of the same shape, size, height, and side (slanted face) dimensions as the baffles in the third and fourth rows. The outer (outside) baffles 64 and 67, and 68 and 71, in the fifth and sixth rows slope downwardly and inwardly from the peripheral wall of the static mixer vessel. The outer baffles can be fabricated by cutting other triangular baffles in half, along their apex. The outer baffles have the same height and side (slanted face) dimensions as the central baffles in the fifth and sixth rows. The minimum horizontal distance and spacing L2'' between the bases of adjacent baffles in the fifth and sixth rows is 0.5 to 1.5 inches, preferably about 1 inch for best results. The minimum horizontal distance and spacing between the apexes of adjacent baffles in the fifth row and in the sixth row is 2 to 2.75 inches, preferably 2.375 inches for best results. The baffles in the fifth row are parallel to each other and to the baffles in the first and third rows. The apexes of the baffles 65 and 66 in the fifth row are positioned laterally outwardly and offset from the central baffle 59 and laterally inwardly and offset from the outer baffles 58 and 60 in the third row. The baffles in the sixth row are parallel to each other and to the baffles in the second and fourth rows, and are at right angles to the baffles in the first, third, and fifth rows as viewed from the top. The apexes of the baffles 69 and 70 in the sixth row are positioned laterally outwardly and offset from the central baffle 62 and laterally inwardly and offset from the outer baffles 61 and 63 in the second and fourth rows.

During testing, the horizontal (lateral) and vertical spacing between elements (baffles) was varied over a wide range. The number of baffles per row and the number of rows were also extensively varied, as were the size and shape of the baffles. The baffle arrangement of FIGS. 6 and 7, as described above, produced superior, unexpected results that were significantly and surprisingly better than all other types of baffle arrangements tested, as described elsewhere in this Patent Application, except for the baffle arrangement of FIGS. 8 and 9 which also produced surprisingly good and significantly better results and which was almost as good as the baffle arrangement of FIGS. 6 and 7. The mixture of raw and spent shale in the static mixers of FIGS. 6–9 were well mixed with substantially uniform and random distribution. Well-mixed, uniform distribution of raw and spent shale significantly improves heat transfer, retorting efficiency, and product yield. The other baffle arrangements including those shown in Applicants' FIGS. 10–19, and ones similar to Ponomarev et al., U.S. Pat. No. 4,211,606, Rammler et al., U.S. Pat. No. 4,038,045, and Eichna, U.S. Pat. No. 2,774,726, produced submarginal (mediocre) to poor mixing of spent and raw shale, and contained numerous unwanted clumps of unmixed shale. Such submarginal to poor mixing typically causes inadequate, slow, and incomplete heat transfer between the hot spent shale and colder fresh shale, unacceptable retorting efficiency, and low product yield.

Figure 8:
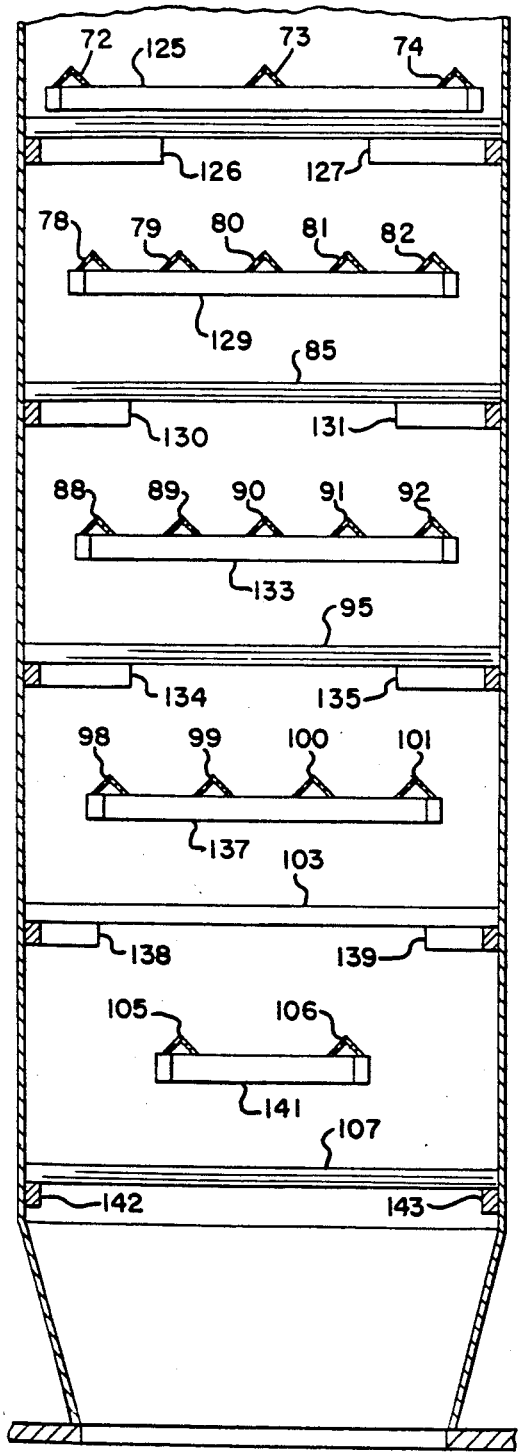
FIGS. 8 and 9 are similar to FIGS. 6 and 7, respectively, except with another arrangement of internal baffles.
Figure 9:
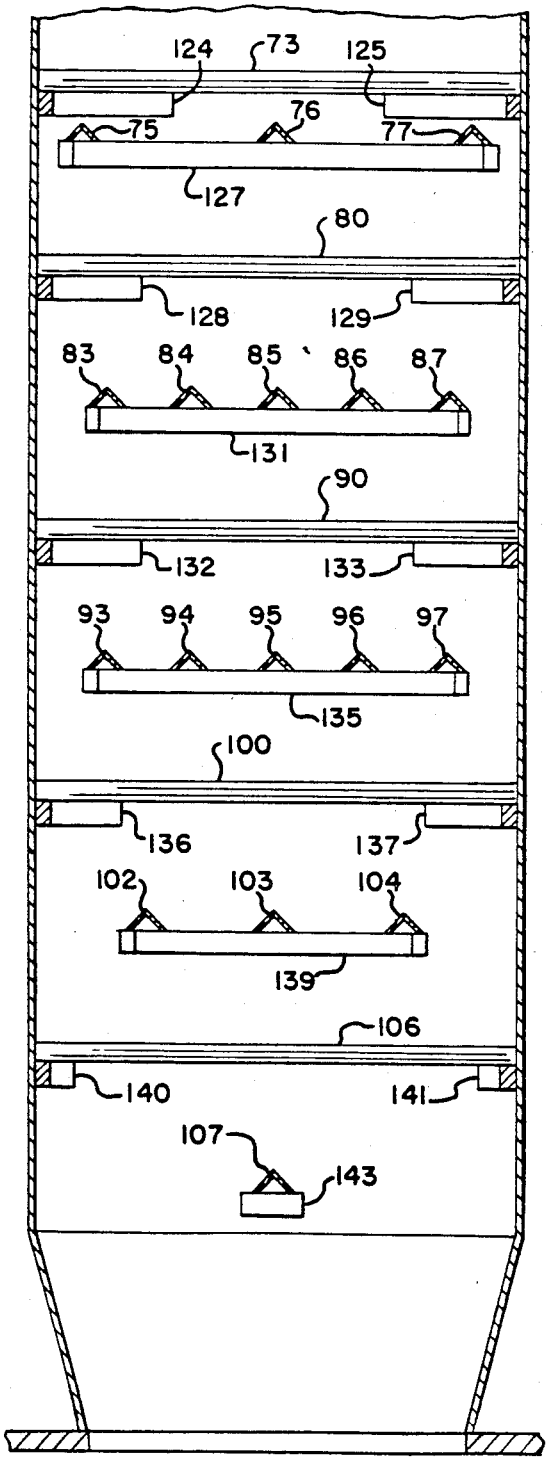

The static mixer of FIGS. 8 and 9 has ten vertically spaced tiers, arrays, levels, and rows of triangular-shaped baffles with their apexes pointed upwardly. All the baffles in the static mixer are of the same shape, size, height, and side (slanted face) dimensions as the inlet rows of baffles 52–57 in FIGS. 6 and 7. The baffles are made of angle irons and extend horizontally across the static mixer. The bases of the baffles in each row are coplanar and in horizontal alignment with each other. The apexes (peaks) of the baffles in each row are of the same height and in coplanar relationship to each other. The sides (slanted faces) of the baffles are at a 45-degree angle relative to the vertical axis. Adjacent sides of each baffle are positioned at a 90-degree (right) inclusive angle to each other. There are three baffles 72–74 in the top (first) inlet row and three baffles 75–77 in the second inlet row. The horizontal and vertical spacing between baffles in the inlet rows, as well as their arrangement and orientation, are similar to the baffles 52–57 of the inlet rows of FIGS. 6 and 7, although the outer baffles 72, 74, 75, and 77 can be spaced somewhat further inwardly from the peripheral wall of the static mixer, if desired.

In the static mixer of FIGS. 8 and 9, there are: five baffles 78–82, 83–87, 88–92, or 93–97 in each of the fourth, fifth, and sixth rows (from the top). The baffles in each of the rows are uniformly spaced at equal intervals across the static mixer, as well as from the peripheral walls of the static mixer. The minimum horizontal spacing and distance between the bases of adjacent baffles in rows 3–6 is from 0.5 to 1 inch, preferably 0.75 inch for best results. The minimum vertical distance (height) and spacing between the apexes (top) of the baffles in rows 3–6, as well as rows 7–10, to the bases (bottom) of the baffles of the row immediately above the indicated row is 1.5 to 2.5 inches, preferably 2 inches for best results. The apexes of the center baffles 73, 80, and 90 in rows 1, 3, and 5 (FIG. 8) are in vertical alignment and registration with each other along the vertical axis of the static mixer. The apexes of the center baffles 76, 85, and 95 (FIG. 9) in rows 2, 4, and 6 are in vertical alignment and registration with each other and positioned along the vertical axis of the static mixer. The baffles in rows 1, 3, 5, 7, and 9 are parallel to each other. The baffles in rows 2, 4, 6, 8, and 10 are parallel to each other and positioned at a 90 degree (right) angle to rows 1, 3, 5, 7, and 9 as viewed from the top. The apexes of outer baffles 78, 79, 81, 82, 88, 89, 91, and 92 in rows 3 and 5 are laterally offset and spaced inwardly of the apexes of the outer (outside) baffles 72 and 74 in the first (top inlet) row. The apexes of outer baffles 83, 84, 86, 87, 93, 94, 96, and 97 in rows 4 and 6 are laterally offset and spaced inwardly of the outer (outside) baffles 75 and 77 in the second inlet row.

The static mixer of FIGS. 8 and 9 has four baffles 98–101 in the seventh row (from the top), three baffles 102–104 in the eighth row (from the top), two baffles 105 and 106 in the ninth row, and one baffle in the tenth (bottom) row. The baffles in rows 7–9 are uniformly spaced at equal intervals across the static mixer, as well as from the peripheral walls of the static mixer. All the baffles in the static mixer of FIGS. 8 and 9 are preferably positioned symmetrically about the vertical axis of the static mixer for best results. The minimum horizontal spacing and distance between the bases of adjacent baffles 98–101 in the seventh row is from 0.75 to 1.25 inches, preferably about 1 inch for best results. The minimum horizontal spacing and distance between the bases of adjacent baffles 102–104 in the eighth row is from 1 to 1.75 inches, preferably about 1.35 inches for best results. The minimum horizontal spacing and distance between the bases of baffles 105 and 106 in the ninth row is from 1.5 to 2.5 inches, preferably about 2 inches for best results. The baffles in rows 7–9 are laterally offset from the baffles in rows 3–6. The inner baffles 99 and 100 in the seventh row are spaced inwardly, between, and laterally offset from the inner baffles 89 and 91 in the fifth row. The outer (outside) baffles 102 and 103 in the eighth row are spaced inwardly, between, and laterally offset from the outer (outside) baffles 93 and 97 in the sixth row. Baffles 105 and 106 in the ninth row are spaced inwardly, between, and laterally offset from the outer baffles 98 and 101 in the seventh row. The apex of baffle 107 (FIG. 9) in the bottom row is positioned in vertical alignment and registration along the vertical axis with the apexes of central baffles 76, 85, 95, and 103.

The top two inlet rows (tiers) of baffles in the static mixers of FIGS. 10–19 can either have a single baffle per row as shown or can have the same size, shape, and arrangement of baffles in the top two inlet rows of FIGS. 6–9. Alternate rows (every other row) of baffles in FIGS. 10–19 are spaced parallel to each other and at right angles (peripendicular) to adjacent rows. The bases of the baffles in each row are coplanar and in horizontal alignment with each other. All the baffles are triangular with their apexes pointed upwardly. The baffles are fabricated of angle irons and extend horizontally across their respective static mixers. The sides (slanted faces) of all the baffles are at a 30 degree angle relative to the vertical axis and at a 60 degree inclusive angle to their adjacent sides. The baffles are all supported by supports, beams, and bars (not shown) similar to those shown in FIGS. 6–9. The apexes of the baffles in the third row and below are all spaced two inches vertically below the bases of the baffles in the row immediately above the designated row.

Figure 10:
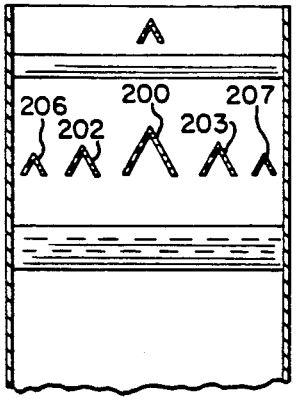
FIGS. 10 and 11 are cross-sectional views of front and side portions of the static mixer with a further arrangement of internal baffles.
Figure 11:
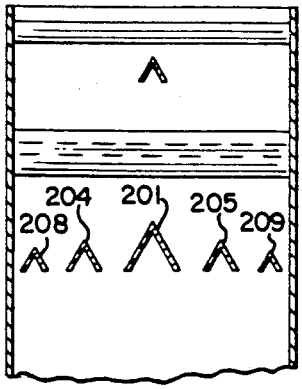

In the static mixer of FIGS. 10 and 11, the third and fourth rows (from the top) each have an enlarged central baffle 200 and 201, two intermediate baffles 202 and 203 or 204 and 205, and two small outer (outside) baffles 206 and 207 or 208 and 209. The sides (cross-sectional span) of the central baffle are one inch, of the intermediate baffles are 0.5 inch, and of the outer baffles are 0.25 inch. The minimum spacing between the central and intermediate baffle is about 0.75 inch. The minimum spacing between the intermediate and outer baffles is about 0.75 inch.

Figure 12:
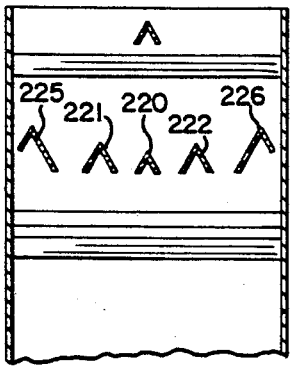
FIGS. 12 and 13 are cross-sectional views of front and side portions of the static mixer with still another arrangement of internal baffles.
Figure 13:
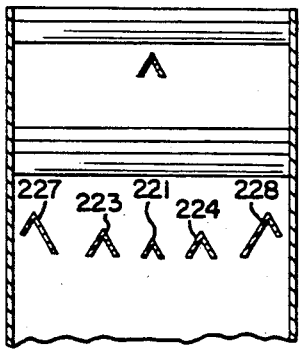

The static mixer of FIGS. 12 and 13 has an inverted baffle arrangement in its third and fourth rows (from the top) relative to the baffle arrangement of FIGS. 10 and 11. In particular, the third and fourth rows each have a small central baffle 220 or 221, two larger intermediate baffles 221 and 222 or 223 and 224, and two enlarged outer (outside) baffles 225 and 226 or 227 and 228. The sides (cross-sectional span) of the central baffle are 0.25 inch, of the intermediate baffles are 0.5 inch, and of the outer baffles are one inch. The minimum spacing between the central and intermediate baffles is 0.75 inch as well as between the intermediate and outer baffles.

Figure 14:
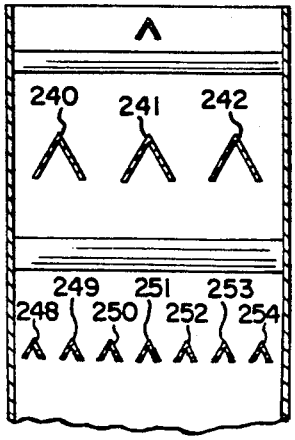
FIGS. 14 and 15 are cross-sectional views of front and side portions of the static mixer with still a further arrangement of internal baffles.
Figure 15:
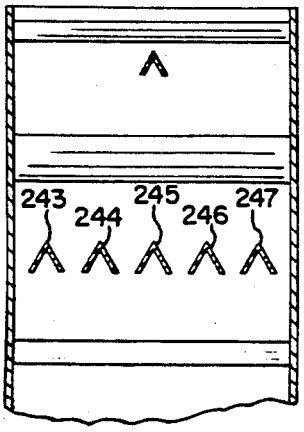

In the static mixer of FIGS. 14 and 15, the third row (from the top) has three baffles 240–242, the fourth row (from the top) has five baffles 243–247, and the bottom (fifth) row has seven baffles 248–254. The baffles in the third row are all of the same size with a cross-sectional span (slanted face dimension) of 1 inch. The baffles in the fourth row are all of the same size with a cross-sectional span (slanted face dimension) of 0.5 inch. The baffles in the bottom row are all of the same size with a cross-sectional span (slanted face dimension) of 0.25 inch. The baffles in each of the rows are spaced at equal intervals across the static mixer.

Figure 16:
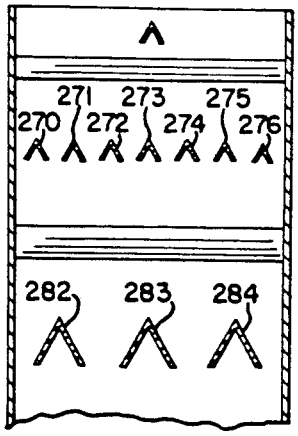
FIGS. 16 and 17 are cross-sectional views of front and side portions of the static mixer with another arrangement of internal baffles.
Figure 17:
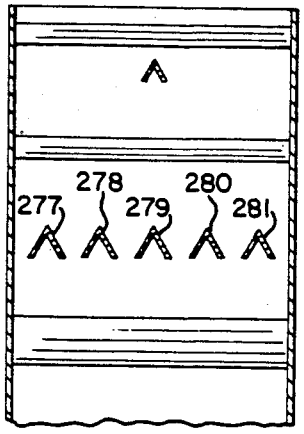

The static mixer of FIGS. 16 and 17 has an inverted baffle arrangement in rows 3–5 (from the top) relative to rows 3–5 of FIGS. 14 and 15. Specifically, there are seven baffles 270–276 in the third row which are similar to the size, shape, and arrangement of baffles 248–254 in the bottom row of FIG. 14. There are five baffles 277–281 in the fourth row which are similar to the size, shape, and arrangement of baffles 243–247 in the fourth row of FIG. 15. There are three baffles 282–284 in the bottom row which are similar to the size, shape, and arrangement of baffles 170–172 in the third row of FIG. 14.

Figure 18:
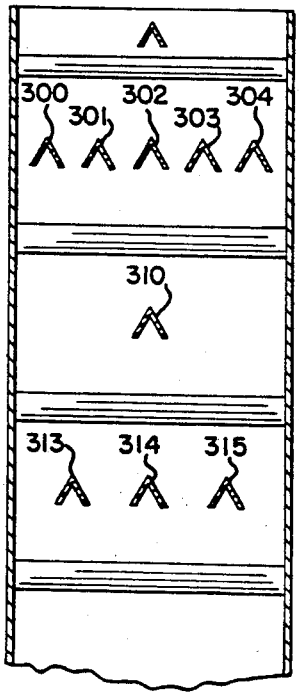
FIGS. 18 and 19 are cross-sectional views of front and side portions of the static mixer with still another arrangement of internal baffles.
Figure 19:
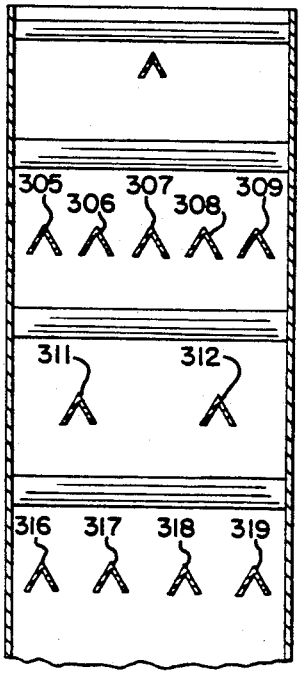

All the baffles in the static mixer of FIGS. 18 and 19 have the same size, shape, and cross-sectional span as the baffles in the top two inlet rows. There are five baffles 300–304 and 305–309 in the third and fourth rows (from the top), respectively. The baffles in the third and fourth rows are symmetrically spaced about the vertical axis and are at uniform, equal intervals across the static mixer. There is one central baffle 310 in the fifth row with its apex positioned along the vertical axis of the static mixer. There are two baffles 311 and 312 in the sixth row (from the top) which are uniformly spaced across the static mixer. There are three baffles 313–315 in the seventh row (from the top) which are uniformly spaced across the static mixer. There are four baffles 316–319 in the bottom (eighth) row which are spaced at equal, uniform intervals across the static mixer.

The static mixer-baffle arrangements of FIGS. 10–19 produced inferior and unacceptable mixing in comparison to the surprisingly good static mixer-baffle arrangements of FIGS. 6–9.

The special arrangement of internals in the static mixer of FIGS. 4–9 also serves to gravitatingly mix and randomly distribute the raw and spent shale much more effectively than prior-art arrangements, such as those shown in Ponomarev et al., U.S. Pat. No. 4,211,606; Rammler et al., U.S. Pat. No. 4,436,588; and Eichna, U.S. Pat. No. 2,744,726. Applicants' special orientation of internals of FIGS. 4–9 provides better mixing which greatly enhances heat transfer between the hot spent shale and the cooler raw shale and substantially increases the rate of kerogen conversion (retorting) of the raw shale to shale oil and light hydrocarbon gases.

Figure 3:
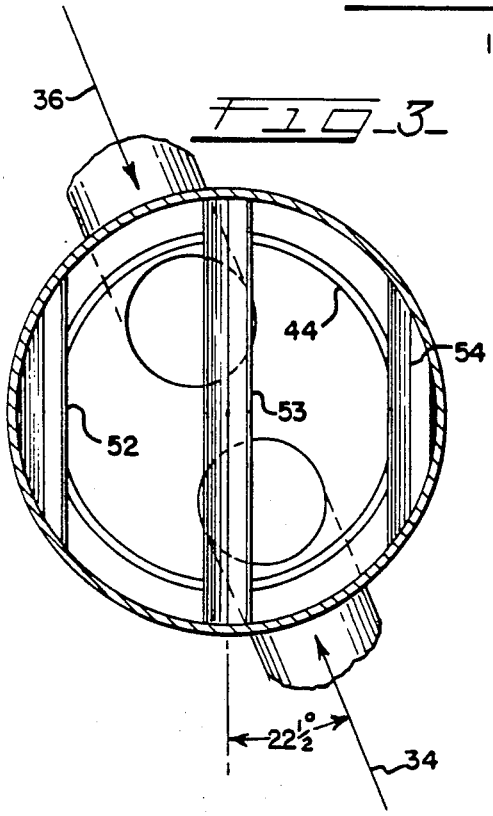
FIG. 3 is a cross-sectional view of the static mixer taken substantially along line 3—3 of FIG. 2.

In the illustrative embodiment, the tops of the feed lines 34 and 36 have annular flanges 142 and 144 (FIG. 4) for attachment to raw and spent shale feed bins or storage hoppers. The feed lines are positioned at an angle of inclination of 5° to 45°, preferably 15°, relative to the vertical axis of the static mixer and most preferably at an angle of 30° relative to each other and symmetrically about the vertical axis to further enhance mixing of the raw and spent oil shale. In this manner, the raw and spent shale feed streams tend to intersect and converge in the upper free-fall section of the static mixer along the vertical axis at a location slightly above the first (top) row of elements 52–54 or 72–74. As viewed from the top of the static mixer, the feed lines can be positioned at an angle from 0° (parallel) to 90° (perpendicular) relative to the top row of elements. It was unexpectedly and surprisingly found during testing that when the feed lines were positioned at an acute angle of 22.5° relative to the top, center, intermediate, middle element 53 or 73 as viewed in top plan view from above the static mixer and as projected in a horizontal plane, as shown in FIG. 3, substantially better mixing and unexpectedly superior results occurred.

The feed lines should have an adequate capacity and diameter for the shale to flow freely into the static mixer. In the preferred embodiment, the feed lines have a diameter of 2 to 3 inches and a height of 10 to 12 inches.

The static mixer and surge bin cooperate with each other to provide a two-stage, gravity flow retort. The static mixer and surge bin are fixedly connected to each other and are made of a fluid-impervious, non-corrosive metal, such as stainless steel, or carbon steel with an internal refractory lining. The static mixer and surge bin are securely mounted and supported above the ground with suitable framework (not shown) so that they remain stationary and fixed relative to the ground.

In order to minimize mechanical breakdown, shutdown time, and fabrication expense, the interior of applicants' static mixer and surge bin has no moving parts, such as the mixing screw conveyor shown in Rammler et al., U.S. Pat. No. 4,038,045.

In contrast to staged turbulent bed retorting and fluidized bed retorting, such as are shown in Tamm et al., U.S. Pat. No. 4,199,432, applicants' static mixer and retort are sealed to prevent the entry of fluidizing gases and turbulent gases, in order to avoid the use of coslly pumps, compressors, and other excessive gas processing equipment, as well as to improve process efficiency.

Combustion (burning) of oil, hydrocarbons, and shale are prevented in both the static mixer and surge bin. This is accomplished by sealing all connections and preventing air and oxygen from entering the static mixer and surge bin.

The surge bin 50 (FIG. 1) is positioned in vertical registration and axial and concentric alignment with the vertical axis of the static mixer at a location below the static mixer. The surge bin has an upright, annular, cylindrical-shaped, outer peripheral side wall 146, a domed, rounded, convex top 48, and a domed, rounded, convex or conical bottom 148. The peripheral side wall of the static surge bin has a greater diameter and cross-sectional area than the peripheral wall of the static mixer. The top of the surge bin is connected to and communicates with the neck of the static mixer. The surge bin and/or static mixer can have optional control valves to selectively control the flow, throughput, and inventory of shale to desired levels.

In operation, raw and spent oil shale are simultaneously fed into the static mixer by the feed lines. The streams of raw shale and spent shale are directed to intersect and commingle with each other along the vertical axis of the static mixer to enhance mixing. In the static mixer, the raw and spent shale initially gravitate downwardly in free-fall in a dilute-phase gravity flow bed. The internals laterally change the direction of flow of the raw and spent shale and deflect the shale in a generally zigzag flow pattern to substantially completely mix the shale together. The solids residence time in the static mixer is preferably less than 10 seconds.

The mixed raw and spent shale gravitate downwardly into the surge bin. While heat exchange (heat transfer) between the raw and spent shale and retorting (kerogen conversion) of the raw shale commence in the static mixer, they are substantially completed in the surge bin.

In the upper portion 150 of the surge bin, the mixed shale gravitates downwardly in a dilute-phase free-fall to further enhance mixing and substantially minimize and prevent back-mixing and choking of the flow of shale. Heat transfer and retorting of the shale continue in the free-fall zone 150. The free-fall zone also provides a disengagement zone or area which helps disengage larger particulates of oil shale dust that are entrained in the effluent product stream. When these larger particles of dust become disentrained (disengaged), they drop back into the dense-phase moving bed at the bottom of the surge bin. The disengagement zone also helps minimize entrainment of the raw and heat carrier fines in the effluent product stream by generally preventing the fines, which are flowing downwardly from the static mixer to the dense-phase moving bed, from being carried away with the upwardly moving product stream.

In the lower portion of the surge bin, the mixed shale gravitates downwardly in a packed, dense-phase moving bed 152. Heat transfer and conversion of kerogen to shale oil and light hydrocarbon gases are substantially completed in the dense-phase moving bed. The total solids residence time (retorting time) in the surge bin is from about 3 minutes to about 10 minutes. The dense-phase moving bed has a substantially greater solids residence time than the dilute-phase moving bed 150.

The effluent product stream of hydrocarbons liberated during retorting is emitted in the surge bin as a gas, vapor, mist, liquid droplets, or a mixture thereof. The product stream is withdrawn from the upper portion of the surge bin through an overhead product outlet line 154. While this arrangement is preferred to minimize dust aggravation, in some circumstances it may be desirable that the product outlet line be located in the middle portion of the surge bin or in a portion of the static mixer.

The effluent product stream is partially dedusted in an internal or external gas-solids separating device, such as one or more cyclone 156 and/or filters. The partially dedusted stream exits the cyclone through transport line 158 where it is transported to one or more separators 160, such as quench towers, scrubbers, or fractionators, also referred to as fractionating columns or distillation columns. In the separator(s), the effluent product stream is separated into fractions of light hydrocarbon gases, steam, light shale oil, middle shale oil, and heavy shale oil. These fractions are discharged from the separator through lines 162–166, respectively. Heavy shale oil has a boiling point over 600° F. to 800° F.; middle shale oil has a boiling point over 400° F. to 500° F.; and light shale oil has a boiling point over 100° F. The effluent oil and gases from the separator can be dedusted further in downstream dedusting equipment and upgraded in a catalytic cracker or hydrotreater or otherwise processed downstream.

The retorted and spent shale particles are discharged from the bottom of the surge bin and are fed by gravity flow through combustor feed line 168 to the bottom portion of an external, dilute-phase, upright combustor lift pipe 170. Shale dust removed from the product stream in cyclone 156 can also be conveyed by gravity flow through dust outlet line 172 to the bottom of the combustor lift pipe. The lift pipe is positioned remote from and spaced externally away from the static mixer and surge bin.

Air or some other oxygen-containing combustion-sustaining lift gas is injected into the bottom of the combustor lift pipe 170 through injector inlet 174. The air is injected at a pressure and flow rate to fluidize, entrain, propel, convey, and transport the retorted and spent shale particles and shale dust generally upwardly through the lift pipe into an overhead combustor vessel 176. Vessel 176 is also referred to as an overhead collection and separation bin. The combustion temperature in the lift pipe and overhead vessel is from 1,000° F. to 1,400° F. Residual carbon contained on the retorted oil shale particles is substantially completely combusted in the lift pipe and overhead vessel leaving spent shale for use as solid heat carrier material. The spent shale is discharged through an outlet in the bottom of the overhead vessel into heat carrier feed line 36 where it is fed by gravity flow into the top of the static mixer 32. Excessive spent shale is withdrawn from the overhead vessel and retort system through discharge line 178.

The carbon contained in the retorted oil shale particles is burned off mainly as carbon dioxide during combustion in the lift pipe and overhead vessel. The carbon dioxide with the air and other products of combustion forms combustion off gases or flue gases which are withdrawn from the upper portion of the overhead vessel 176 through a combustion gas line 180. The combustion gases are dedusted in an external cyclone or an electrostatic precipitator before being discharged into the atmosphere or processed further to recover steam.

Tests 1–43

Black-colored particulates corresponding to spent oil shale and white-colored particulates corresponding to fresh oil shale were fed into Types 1–12 static mixers at an ambient pressure of about one atmosphere and an ambient temperature of about 77° F. The fresh oil shale had an average density of 2.2802 gm/ml. The spent oil shale had an average density of 2.6183 gm/ml.

The Type 1 static mixer was an open plexiglass tube with a six-inch inside diameter.

The Type 2 static mixer was a steel sheet metal tube with a four-inch inside diameter.

The Type 3 static mixer has 24 Kenics-type twisted elements or blades. Three right-hand blades were arranged to form a smooth continuous surface. After a 60° displacement, three left-hand blades were arranged to form a continuous surface and another 60° displacement occurred before the next set of elements. This arrangement was repeated four times.

The Type 4 static mixer had 24 alternating right-hand and left-hand mixing Kenics-type elements and twisted blades. One right-hand blade was used, followed by a left-hand blade displaced 60° from the blade of the right-hand element. Next, a right-hand blade was used, displaced 60° from the blade of the left-hand element.

The Type 5 static mixer had 24 mixing elements. The first six elements were left-hand blades. Each of the left-hand blades had one tooth offset to the left. Reference to the terms "tooth", "teeth", "notch", or "notches" as used in this application mean a rotation of 12 degrees. The next six elements were right-hand blades. Each of the right-hand blades had one tooth offset to the right. The next six elements were arranged the same as the first six elements. The last six elements . were arranged the same as the second six elements The Type 6 static mixer was similar to the Type 5 static mixer except that each blade was offset two teeth to the right or left rather than one tooth.

The Type 7 static mixer was a double helix mixer arranged to form two intertwining helixes twisting in opposite directions. This mixer had 24 elements. The first left-hand blade was positioned three notches to the right of the first right-hand blade. Subsequent right-hand elements were positioned three notches to the right of the right-hand element above it to form a helix pattern. All left-hand elements were positioned three notches to the left of the left-hand element above them.

The Type 8 static mixer was a random assembly static mixer. A reference point was selected on the first element. Subsequent elements were rotatably positioned relative to the reference point by the following number of teeth.

| Element Number | Number of Teeth from Reference Point | Right Hand Blade (r) or Left Hand Blade (l) |
|---|---|---|
| 1 | 0 | r |
| 2 | 8 | r |
| 3 | 7 | r |
| 4 | 1 | r |
| 5 | 2 | l |
| 6 | 1 | l |
| 7 | 9 | l |
| 8 | 5 | l |
| 9 | 8 | r |
| 10 | 3 | l |
| 11 | 9 | l |
| 12 | 5 | r |
| 13 | 9 | l |
| 14 | 5 | l |
| 15 | 8 | r |
| 16 | 1 | l |
| 17 | 2 | r |
| 18 | 6 | l |
| 19 | 3 | r |
| 20 | 4 | l |
| 21 | 9 | r |
| 22 | 4 | r |
| 23 | 8 | r |
| 24 | 5 | l |

The number of teeth and direction of the blade were selected by using a table of random numbers.

The Type 9 static mixer was a back-and-forth static mixer. It had elements arranged to form smooth helical channels that twisted in alternate directions. This mixer used 24 elements. Two-thirds of the mixer was blocked off; solids moved through only one of the 3 channels in the mixer. Six right-hand elements were followed by six left-hand elements and the pattern was repeated.

The Type 10 static mixer was similar to the Type 9 static mixer but was only one-half its length.

The Type 11 static mixer was similar to the Type 5 static mixer but was only one-half its length.

The Type 12 static mixer had internal elements made from galvanized steel mesh. The wire diameter of the mesh was $\frac{1}{8}$ inch. The opening of the mesh was one inch. The static mixer had 33 sections of mesh spaced vertically at one-inch intervals and was arranged in a repeating order of three special segments.

Testing of Types 1–12 static mixers were conducted under the conditions shown in Table 1.

TABLE 1

| Test No. | Fraction of Solids No. 1 | Fraction of Solids No. 2 | Feed Rate, lbs/hr | Particle Median Size, mm No. 1 | Particle Median Size, mm No. 2 | Static Mixer Type |
|---|---|---|---|---|---|---|
| 1 | 0.500 | 0.500 | 5200 | 2.10 | 1.75 | 1 |
| 2 | 0.500 | 0.500 | 5200 | 2.10 | 1.75 | 3 |
| 3 | 0.330 | 0.670 | 3900 | 2.10 | 1.75 | 3 |
| 4 | 0.670 | 0.330 | 3900 | 2.10 | 1.75 | 4 |
| 5 | 0.500 | 0.500 | 5200 | 2.10 | 1.75 | 4 |
| 6 | 0.330 | 0.670 | 3900 | 2.10 | 1.75 | 1 |
| 7 | 0.330 | 0.670 | 3900 | 2.10 | 1.75 | 4 |
| 8 | 0.330 | 0.670 | 7800 | 2.10 | 1.75 | 1 |
| 9 | 0.330 | 0.670 | 7800 | 2.10 | 1.75 | 5 |
| 10 | 0.330 | 0.670 | 7800 | 2.10 | 1.75 | 3 |
| 11 | 0.330 | 0.670 | 7800 | 2.10 | 1.75 | 6 |
| 12 | 0.330 | 0.670 | 7800 | 2.10 | 1.75 | 7 |
| 13 | 0.330 | 0.670 | 7800 | 2.10 | 1.75 | 8 |
| 14 | 0.330 | 0.670 | 7800 | 2.10 | 1.75 | 9 |
| 15 | 0.250 | 0.750 | 10400 | 2.10 | 1.75 | 2 |
| 16 | 0.330 | 0.670 | 7800 | 2.10 | 1.75 | 2 |
| 17 | 0.330 | 0.670 | 7800 | 2.10 | 3.70 | 2 |
| 18 | 0.330 | 0.670 | 7800 | 2.10 | 3.70 | 1 |
| 19 | 0.330 | 0.670 | 7800 | 0.75 | 3.70 | 1 |
| 20 | 0.250 | 0.750 | 10400 | 0.75 | 3.70 | 1 |

TABLE 2

| Test No. | Fraction of Solids No. 1 | Fraction of Solids No. 2 | Feed Rate, lbs/hr | Particle Median Size, mm No. 1 | Particle Median Size, mm No. 2 | Static Mixer Type |
|---|---|---|---|---|---|---|
| 21 | 0.250 | 0.750 | 10400 | 0.75 | 3.70 | 5 |
| 22 | 0.330 | 0.670 | 7800 | 0.75 | 3.70 | 5 |
| 23 | 0.330 | 0.670 | 7800 | 0.75 | 3.70 | 7 |
| 24 | 0.250 | 0.750 | 10400 | 0.75 | 3.70 | 7 |
| 25 | 0.250 | 0.750 | 10400 | 0.75 | 3.70 | 7 |
| 26 | 0.330 | 0.670 | 7800 | 0.75 | 3.70 | 9 |
| 27 | 0.330 | 0.670 | 7800 | 0.75 | 3.70 | 2 |
| 28 | 0.250 | 0.750 | 10400 | 0.75 | 3.70 | 2 |
| 29 | 0.330 | 0.670 | 7800 | 0.75 | 3.70 | 10 |
| 30 | 0.330 | 0.670 | 7800 | 0.75 | 3.70 | 11 |
| 31 | 0.500 | 0.500 | a. | 0.75 | 3.70 | 5 |
| 32 | 0.500 | 0.500 | a. | 0.75 | 3.70 | 2 |
| 33 | 0.500 | 0.500 | a. | 0.75 | 3.70 | 12 |
| 34 | 0.330 | 0.670 | 7800 | 0.75 | 3.70 | 12 |
| 35 | 0.500 | 0.500 | a. | 2.10 | 1.75 | 2 |
| 36 | 0.500 | 0.500 | a. | 2.10 | 1.75 | 5 |
| 37 | 0.500 | 0.500 | a. | 2.10 | 1.75 | 9 |
| 38 | 0.500 | 0.500 | a. | 2.10 | 1.75 | 12 |
| 39 | 0.330 | 0.670 | 7800 | 2.10 | 1.75 | 12 |
| 40 | 0.500 | 0.500 | a. | 2.10 | 1.75 | 1 |
| 41 | 0.500 | 0.500 | a. | 2.10 | 1.75 | 7 |
| 42 | 0.500 | 0.500 | b. | 2.10 | 1.75 | 5 |
| 43 | 0.500 | 0.500 | b. | 2.10 | 1.75 | 2 |

a. Dense phase feed
b. Dense phase outlet control

Tests 44–62

Raw (fresh) oil shale and spent oil shale were fed into various other types of static mixers at the indicated feed rates shown in Table 3. The pressures, temperatures, and average densities of the fresh and spent shale were similar to Tests 1–43. The static mixers of Tests 44–62 had triangular stainless steel internal baffles (elements) and were arranged in the manner indicated in Table 3. The size (minimum slanted face dimension) of each of the baffles in the first two inlet rows is indicated as L1. The number of rows of baffles is indicated as N. The size (minimum slanted face dimension) of each of the other baffles is indicated as L1'. The minimum horizontal spacing between adjacent baffles in each row is indicated as L2. The minimum vertical spacing and height between the rows of baffles are indicated as L3.

TABLE 3

| Test No. | Shale Feed Rate, lb/hr Fresh | Shale Feed Rate, lb/hr Spent | Static Mixer Type L1 inches | N rows | L1' inches | L2 inches | L3 inches |
|---|---|---|---|---|---|---|---|
| 44 | 650 | 3250 | 0.5 | 8 | 0.5 | 0.75 | 2 |
| 45 | 650 | 1950 | 0.5 | 8 | 0.5 | 0.75 | 2 |
| 46 | 650 | 1300 | 0.5 | 8 | 0.5 | 0.75 | 2 |
| 47 | 650 | 1300 | 0.5 | 4 | 0.5 | 0.75 | 2 |
| 48 | 650 | 2600 | 0.5 | 4 | 0.5 | 0.75 | 2 |
| 49 | 650 | 1300 | 0.5 | 2 | 0.5 | 0.75 | 2 |
| 50 | 650 | 2600 | 0.5 | 2 | 0.5 | 0.75 | 2 |
| 51 | 650 | 1300 | 0.5 | 2 | 0.5 | 0.75 | 4 |
| 52 | 650 | 1300 | 0.5 | 2 | 0.5 | 0.75 | 1 |
| 53 | 650 | 1300 | 0.5 | 2 | 0.5 | 1.25 | 2 |
| 54 | 650 | 1300 | 0.5 | 2 | 0.25 | 0.75 | 2 |
| 55 | 650 | 1300 | 0.5 | 2 | 1.0 | 0.75 | 2 |
| 56 | 650 | 1300 | 0.5 | 2 | 0.25 | 1.25 | 2 |
| 57 | 650 | 1300 | 0.5 | 4 | 0.5 | 0.75 | 2 |
| 58 | 650 | 1300 | 0.5 | 2 | 0.5 | 0.75 | 2 |
| 59 | 650 | 1300 | 2.0 | 2 | 0.5 | 0.75 | 2 |
| 60 | 650 | 1300 | 0.5 | 2 | 0.5 | 0.75 | 2 |
| 61 | 1300 | 2600 | 0.5 | 2 | 0.5 | 0.75 | 2 |
| 62 | 2600 | 7800 | 0.5 | 2 | 0.5 | 0.75 | 2 |

Tests 63–74

Fresh oil shale and spent oil shale were fed into a static mixer of the type indicated below under conditions similar to Tests 44–62.

TABLE 4

| Test No. | Shale Feed Rate, lbs/hr Fresh | Spent | Static Mixer Type |
|---|---|---|---|
| 63 | 650 | 1300 | 1 |
| 64 | 650 | 1300 | 7 |
| 65 | 650 | 1300 | 9 |
| 66 | 650 | 1300 | 12 |
| 67 | 650 | 1300 | FIGS. 10–11 |
| 68 | 650 | 1300 | FIGS. 12–13 |
| 69 | 650 | 1300 | FIGS. 14–15 |
| 70 | 650 | 1300 | FIGS. 16–17 |
| 71 | 650 | 1300 | FIGS. 18–19 |
| 72 | 650 | 1300 | FIGS. 6–7 |
| 73 | 650 | 1300 | FIGS. 8–9 |
| 74 | 2600 | 7800 | FIGS. 6–7 |

Other tests were conducted as previously described.

The mixtures, distributions, and patterns produced from the above tests were all photgraphically analyzed and compared. Based upon this photographic analysis and comparison, as well as visual observations, it was overwelmingly concluded that the static mixers of FIGS. 6–9 produced superior results over the other types of static mixtures tested.

The mixing of raw and spent oil shale in the static mixers of FIGS. 6–9 was substantially complete, full, and random with virtually uniform distribution of fresh and spent shale particles. The testing of the static mixers of FIGS. 6–9 produced unexpected, surprisingly good results and superior mixing (i.e. a well-mixed matrix of fresh and spent oil shale) over the prior art and other types of static mixers shown in the Tables as well as those described previously. Such superior mixing greatly enhances retorting efficiency, effectiveness, thermal conductivity (heat transfer between the hot spent shale and colder fresh oil shale), and product yield. The prior art and other types of static mixers tested produced unacceptable, inadequate, mediocre to very poor (sub-marginal) incomplete mixing of raw and spent oil shale. Such unacceptable mixing substantially retards (diminishes) retorting efficiency, effectiveness, thermal conductivity (heat transfer between the hot spent shale and colder fresh oil shale), and product yield.

Among the many advantages of the gravity flow retorting process and system of FIGS. 1–9 are:

1. Lower construction, operating, and maintenance costs.
2. Reduced downtime.
3. Simplicity and ease of construction.
4. Greater throughput capacity.
5. Better mixing.
6. Improved retorting effectiveness and efficiency.
7. Increased product yield.

While the preferred solid heat carrier material is fully combusted spent oil shale, other types of solid heat carrier material can also be used such as partially combusted oil shale, retorted oil shale, ceramic balls, metal balls, retorting catalysts, cracking catalysts, retorting promoters and enhancers, and combinations thereof. The catalysts can be crystalline aluminosilicates, zeolites, or molecular sieves and can be on a silica or alumina support.

Although embodiments of this invention have been shown and described, it is to be understood that various modifications and substitutions, as well as rearrangements and combinations of parts or process steps, can be made by those skilled in the art without departing from the novel spirit and scope of this invention.

What is claimed is:

1. A system for retorting oil shale, comprising:

a static mixer having an upper free-fall section with a domed roof and a lower elongated deflector section, said deflector section having a greater diameter than said upper section, said static mixer having a vertical axis and having only stationary parts and components consisting of six vertically spaced tiers of triangular-shaped internals having upwardly pointing apexes in said deflector section, alternate tiers of said internals being spaced substantially parallel and at about right angles to adjacent tiers as viewed from said roof, said tiers extending substantially horizontally across said deflector section, said six tiers, as viewed from said roof, consisting of first and second tiers having only three triangular-shaped internals of substantially the same size, and third, fourth, fifth and sixth tiers positioned beneath said first and second tiers and having similarly sized triangular-shaped internals, said internals in said first and second tiers being smaller than the internals in said third through sixth tiers, the third and fourth tiers each having three triangular-shaped internals, the first through fourth tiers each having a center internal with an apex positioned substantially along said vertical axis, said first through fourth tiers each having outer internals with the apexes of the outer internals of the third and fourth tiers spaced laterally inwardly of the outer internals in the first and second tiers, the fifth and sixth tiers each having two intermediate triangular-shaped internals and two downwardly and inwardly sloping outer internals with the apexes of the intermediate internals being spaced outwardly and offset from the apexes of said center internals of the first through fourth tiers, said outer internals in said fifth and sixth tiers being spaced outwardly from said outer internals in said third and fourth tiers, said six tiers of internals being arranged to cooperate with each other in the above manner to substantially completely mix and randomly distribute raw and spent oil shale together in said deflector section;

a raw oil shale feed line positioned at an angle of about 30 degrees relative to said vertical axis and connected to said domed roof;

a solid heat carrier material feed line positioned at an angle of about 30 degrees relative to said vertical axis and at an inclusive angle of about 60 degrees relative to said raw oil shale feed line and connected to said domed roof, said feed lines are positioned at an acute angle of about 22.5 degrees relative to said apex of said center internal of said first tier of triangular-shaped internals as viewed from said domed roof;

a surge bin positioned below and communicating with said deflector section for substantially completing the retorting of said raw oil shale;

a combustor connected to said surge bin for combusting said retorted shale; and a separator connected to said surge bin for separating at least one fraction of shale oil from hydrocarbons liberated from said raw oil shale in said bin.

2. A system for retorting oil shale, comprising:

a static mixer having an upper free-fall section with a top and a lower elongated deflector section, said deflector section having a greater diameter than said upper section, said static mixer having a vertical axis and having only stationary parts and components consisting of ten vertically spaced rows of triangular-shaped internals comprising baffles having upwardly pointing apexes in said deflector section, alternate rows of said baffles being spaced substantially parallel and at about right angles to adjacent rows as viewed from said top, said rows extending substantially horizontally across said deflector section, said baffles in all ten rows being of substantailly the same size, said ten rows, as viewed from said top, consisting of first and second rows having three uniformly spaced triangular shaped baffles, third, fourth, fifth and sixth rows having five uniformly spaced triangular-shaped baffles, a seventh row having four uniformly spaced triangular-shaped baffles, an eighth row having three uniformly spaced triangular-shaped baffles, a ninth row having two uniformly spaced triangular-shaped baffles, and a tenth row having one triangular-shaped baffle positioned along the vertical axis, said ten rows of baffles cooperating with each other to substantially mix raw and spent oil shale, said three uniformly spaced triangular-shaped baffles in said first row including outwardly positioned triangular-shaped baffles and an intermediate triangular-shaped baffle having an apex positioned between said outwardly positioned baffles;

a raw oil shale feed line positioned at an angle of about 30 degrees relative to said vertical axis and connected to said top of said free-fall section;

a solid heat carrier material feed line positioned at an angle of about 30 degrees relative to said vertical axis and at an inclusive angle of about 60 degrees relative to said raw oil shale feed line and connected to said top of said free-fall section, said raw and spent shale feed lines are positioned at an angle of about 22.5 degrees relative to said apex of said intermediate baffle of said first row of said triangular-shaped baffles as viewed from the top;

a surge bin positioned below and communicating with said deflector section for substantially completing the retorting of said mixed raw and spent oil shale;

a combustor connected to said surge bin for combusting said retorted shale; and a separator connected to said bin for separating at least one fraction of shale oil from hydrocarbons liberated from said raw oil shale in said surge bin.

* * * * *